US010923012B1

(12) United States Patent
Hu et al.

(10) Patent No.: US 10,923,012 B1
(45) Date of Patent: Feb. 16, 2021

(54) DISPLAYS WITH MULTIPLE REFRESH RATE MODES

(71) Applicant: Apple Inc., Cupertino, CA (US)

(72) Inventors: Jiaxi Hu, San Jose, CA (US); Hao-Lin Chiu, Campbell, CA (US); Shatam Agarwal, Austin, TX (US); Kwang Soon Park, San Ramon, CA (US); Joonggun Lee, Los Gatos, CA (US); Kyung Wook Kim, Saratoga, CA (US); Shih Chang Chang, Cupertino, CA (US); Fenghua Zheng, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/814,879

(22) Filed: Mar. 10, 2020

(30) Foreign Application Priority Data

Mar. 5, 2020 (CN) ..... 202010146479.5

(51) Int. Cl.
*G09G 3/20* (2006.01)

(52) U.S. Cl.
CPC ..... *G09G 3/20* (2013.01); *G09G 2310/0272* (2013.01); *G09G 2310/0278* (2013.01); *G09G 2310/0286* (2013.01); *G09G 2310/0297* (2013.01)

(58) Field of Classification Search
CPC ..... G09G 3/20; G09G 2310/0272; G09G 2310/0278; G09G 2310/0286; G09G 2310/0297
See application file for complete search history.

(56) References Cited

U.S. PATENT DOCUMENTS

| | | | |
|---|---|---|---|
| 9,886,886 | B2 | 2/2018 | Amundson et al. |
| 9,940,886 | B2 | 4/2018 | Lee et al. |
| 10,001,855 | B2 | 6/2018 | Chen |
| 10,074,321 | B2 | 9/2018 | De Greef |
| 10,109,240 | B2 | 10/2018 | Chang et al. |
| 10,269,316 | B2 | 4/2019 | Sakurai |
| 10,339,866 | B2 | 7/2019 | Noguchi et al. |

(Continued)

FOREIGN PATENT DOCUMENTS

| | | | |
|---|---|---|---|
| CN | 1783189 | A | 6/2006 |
| CN | 102792361 | A | 11/2012 |

(Continued)

*Primary Examiner* — Peter D McLoone
(74) *Attorney, Agent, or Firm* — Treyz Law Group, P.C.; Joseph F. Guihan

(57) ABSTRACT

An electronic device may include a display. The display may include display driver circuitry that is configured to provide image data to columns of pixels and gate driver circuitry that is configured to provide control signals to rows of pixels. The display may be operable at a native refresh rate that is equal to the highest refresh rate at which the display has full resolution. The display may also be operable in a high refresh rate mode with a high refresh rate that is twice (or some other scaling factor greater than) the native refresh rate. To enable operation at the high refresh rate mode, vertical resolution of the display may be sacrificed. In other words, rows of pixels may be grouped together into effective rows that are then scanned in sequence. The gate driver circuitry may be formed as thin-film transistor circuitry or from gate driver integrated circuits.

19 Claims, 11 Drawing Sheets

(56) References Cited

U.S. PATENT DOCUMENTS

| | | | | |
|---|---|---|---|---|
| 10,431,177 | B2 | 10/2019 | Nakanishi | |
| 10,515,604 | B2 | 12/2019 | Chung et al. | |
| 10,566,355 | B2 | 2/2020 | Takahashi | |
| 2016/0189616 | A1 | 6/2016 | Oh et al. | |
| 2017/0185198 | A1 | 6/2017 | Shepelev | |
| 2018/0075809 | A1* | 3/2018 | Chang | G09G 3/3266 |
| 2018/0277037 | A1 | 9/2018 | Lin et al. | |
| 2019/0035337 | A1 | 1/2019 | Kato | |
| 2020/0051512 | A1 | 2/2020 | Li et al. | |

FOREIGN PATENT DOCUMENTS

| | | | |
|---|---|---|---|
| CN | 104658507 | A | 5/2015 |
| CN | 107767808 | A | 3/2018 |
| CN | 107808625 | A | 3/2018 |

* cited by examiner

DISPLAYS WITH MULTIPLE REFRESH RATE MODES

This application claims priority to CN patent application No. 202010146479.5, filed on Mar. 5, 2020, which is hereby incorporated by reference herein in its entirety.

BACKGROUND

This relates generally to displays, and, more particularly, to displays with gate driver circuitry.

Electronic devices often include displays. For example, cellular telephones and portable computers include displays for presenting information to users. An electronic device may have an organic light-emitting diode display based on organic-light-emitting diode pixels or a liquid crystal display based on liquid crystal pixels.

Displays may include driving circuitry that is used to provide signals to the display to operate the display. If care is not taken, the driving circuitry may lack desired flexibility or may undesirably increase the size of an inactive border region of the display.

It would therefore be desirable to be able to provide improved driver circuitry for electronic device displays.

SUMMARY

An electronic device may include a display. The display may include an array of pixels such as organic light-emitting diode pixels or liquid crystal display pixels. The display may include display driver circuitry that is configured to provide image data to columns of pixels in the display. The display may also include gate driver circuitry that is configured to provide control signals to rows of pixels in the display.

Displays may be operable at a native refresh rate that is equal to the highest refresh rate at which the display has full resolution. When operating at the native refresh rate, each row of pixels may be scanned sequentially.

Displays may also be operable in a high refresh rate mode with a high refresh rate. In the high refresh rate mode, the display may operate at a refresh rate that is twice the native refresh rate, three times the native refresh rate, or four times the native refresh rate (as examples). The native refresh rate may be 120 Hz and the high refresh rate may be 240 Hz, as one example. The native refresh rate may be 60 Hz and the high refresh rate may be 120 Hz, 180 Hz, or 240 Hz, as another example.

To enable operation at the high refresh rate mode, vertical resolution of the display may be sacrificed. In other words, rows of pixels may be grouped together into effective rows that are then scanned in sequence. If the refresh rate is two times greater than the native refresh rate, each effective row will include two actual rows. If the refresh rate is three times greater than the native refresh rate, each effective row will include three actual rows.

Gate driver circuitry that is operable in the native refresh rate mode and the high refresh rate mode may be formed as thin-film transistor circuitry in an inactive area of the display. The gate driver circuitry may include a shift register with a plurality of register circuits. The shift register may receive two start pulses that are either concurrent or staggered depending on the operating mode.

Gate driver circuitry that is operable in the native refresh rate mode and the high refresh rate mode may also be formed from gate driver integrated circuits in an inactive area of the display. The gate driver integrated circuits may include a shift register with a plurality of register circuits. The shift register may include multiplexers that are used to select an appropriate output for each register circuit based on the operating mode.

DETAILED DESCRIPTION

Figure 1:
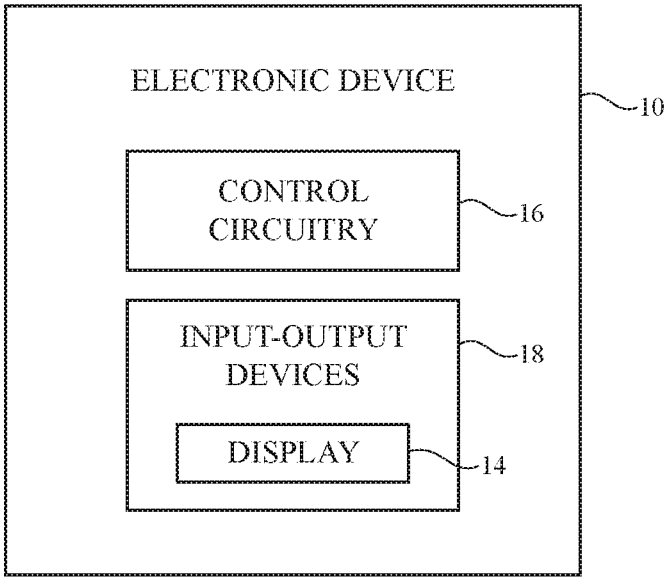
FIG. 1 is a schematic diagram of an illustrative electronic device having a display in accordance with an embodiment.

An illustrative electronic device of the type that may be provided with a display is shown in FIG. 1. Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a display, a computer display that contains an embedded computer, a computer display that does not contain an embedded computer, a television, a gaming device, a navigation device, an embedded system such as a system in which electronic equipment with a display is mounted in a kiosk or automobile, or other electronic equipment. Electronic device 10 may have the shape of a pair of eyeglasses (e.g., supporting frames), may form a housing having a helmet shape, or may have other configurations to help in mounting and securing the components of one or more displays on the head or near the eye of a user.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 18 may be used to allow data to be supplied to device 10 and to allow data to be provided from device 10 to external devices. Input-output devices 18 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 18 and may receive status information and other output from device 10 using the output resources of input-output devices 18.

Input-output devices 18 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14.

Display 14 may be an organic light-emitting diode (OLED) display, a display formed from an array of discrete light-emitting diodes each formed from a crystalline semiconductor die, a liquid crystal display (LCD), or any other suitable type of display. Electronic device 10 may have a housing (e.g., formed from metal, glass, plastic, or a combination of two or more of these materials) that houses display 14 and forms exterior surfaces of the electronic device (e.g., the housing may form a rear face and sidewalls of the electronic device and the display may form the front face of the electronic device).

Figure 2:
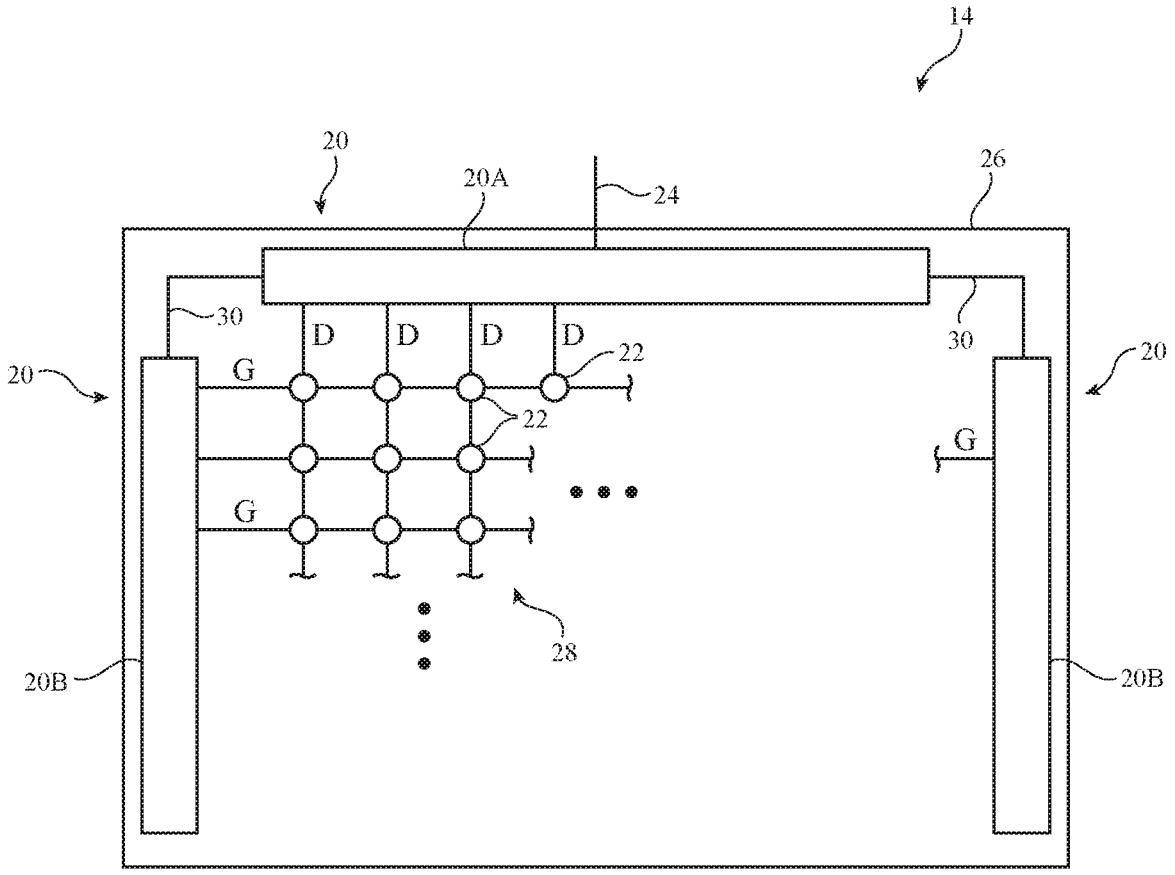
FIG. 2 is a schematic diagram of an illustrative display in accordance with an embodiment.

FIG. 2 is a diagram of an illustrative display. As shown in FIG. 2, display 14 may include layers such as substrate layer 26. Substrate layers such as layer 26 may be formed from rectangular planar layers of material or layers of material with other shapes (e.g., circular shapes or other shapes with one or more curved and/or straight edges). The substrate layers of display 14 may include glass layers, polymer layers, composite films that include polymer and inorganic materials, metallic foils, etc.

Display 14 may have an array of pixels 22 for displaying images for a user such as pixel array 28. Pixels 22 in array 28 may be arranged in rows and columns. The edges of array 28 (sometimes referred to as active area 28) may be straight or curved (i.e., each row of pixels 22 and/or each column of pixels 22 in array 28 may have the same length or may have a different length). There may be any suitable number of rows and columns in array 28 (e.g., ten or more, one hundred or more, or one thousand or more, etc.). Display 14 may include pixels 22 of different colors. As an example, display 14 may include red pixels, green pixels, and blue pixels. If desired, a backlight unit may provide backlight illumination for display 14.

Display driver circuitry 20 may be used to control the operation of pixels 28. Display driver circuitry 20 may be formed from integrated circuits, thin-film transistor circuits, and/or other suitable circuitry. Illustrative display driver circuitry 20 of FIG. 2 includes display driver circuitry 20A and additional display driver circuitry such as gate driver circuitry 20B. Gate driver circuitry 20B may be formed along one or more edges of display 14. For example, gate driver circuitry 20B may be arranged along the left and right sides of display 14 in an inactive area of the display as shown in FIG. 2. Gate driver circuitry 20B may include gate drivers and emission drivers.

As shown in FIG. 2, display driver circuitry 20A (e.g., one or more display driver integrated circuits, thin-film transistor circuitry, etc.) may contain communications circuitry for communicating with system control circuitry over signal path 24. Path 24 may be formed from traces on a flexible printed circuit or other cable. The control circuitry may be located on one or more printed circuits in electronic device 10. During operation, the control circuitry (e.g., control circuitry 16 of FIG. 1) may supply circuitry such as a display driver integrated circuit in circuitry 20 with image data for images to be displayed on display 14. Display driver circuitry 20A of FIG. 2 is located at the top of display 14. This is merely illustrative. Display driver circuitry 20A may be located at both the top and bottom of display 14 or in other portions of device 10.

To display the images on pixels 22, display driver circuitry 20A may supply corresponding image data to data lines D (e.g., vertical signal lines) while issuing control signals to supporting display driver circuitry such as gate driver circuitry 20B over signal paths 30. With the illustrative arrangement of FIG. 2, data lines D run vertically through display 14 and are associated with respective columns of pixels 22. During compensation operations, column driver circuitry 20 may use paths such as data lines D to supply a reference voltage.

Gate driver circuitry 20B (sometimes referred to as gate line driver circuitry or horizontal control signal circuitry) may be implemented using one or more integrated circuits and/or may be implemented using thin-film transistor circuitry on substrate 26. Horizontal control lines G (sometimes referred to as gate lines, scan lines, emission control lines, etc.) run horizontally through display 14. Each gate line G is associated with a respective row of pixels 22. If desired, there may be multiple horizontal control lines such as gate lines G associated with each row of pixels. Individually controlled and/or global signal paths in display 14 may also be used to distribute other signals (e.g., power supply signals, etc.). The number of horizontal signal lines in each row may be determined by the number of transistors in the display pixels 22 that are being controlled independently by the horizontal signal lines. Display pixels of different configurations may be operated by different numbers of control lines, data lines, power supply lines, etc.

Gate driver circuitry 20B may assert control signals on the gate lines G in display 14. For example, gate driver circuitry 20B may receive clock signals and other control signals from circuitry 20A on paths 30 and may, in response to the received signals, assert a gate line signal on gate lines G in sequence, starting with the gate line signal G in the first row of pixels 22 in array 28. As each gate line is asserted, data from data lines D may be loaded into a corresponding row of pixels. In this way, control circuitry such as display driver circuitry 20A and 20B may provide pixels 22 with signals that direct pixels 22 to display a desired image on display 14. Each pixel 22 may have a light-emitting diode and circuitry (e.g., thin-film circuitry on substrate 26) that responds to the control and data signals from display driver circuitry 20.

Figure 3:
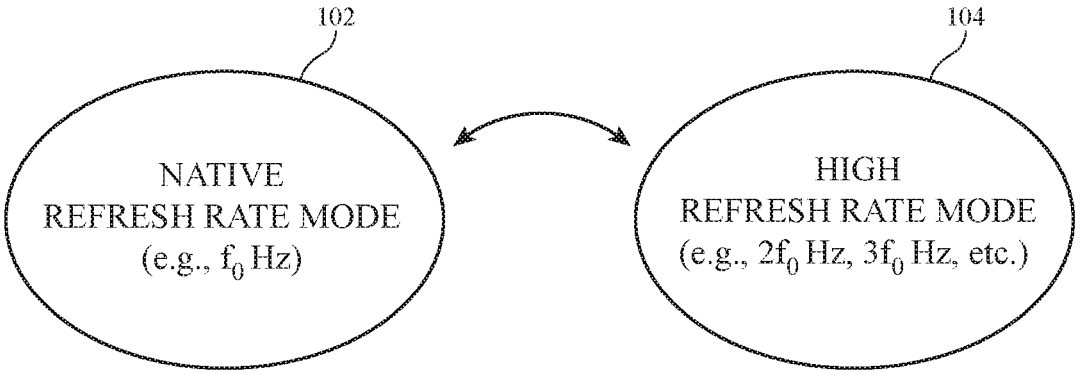
FIG. 3 is a state diagram showing how a display of the type shown in FIG. 2 may be operable in both a native refresh rate mode and a high refresh rate mode in accordance with an embodiment.

FIG. 3 is a state diagram showing how display 14 may be operable in multiple refresh rate modes. As shown, display 14 may be operable in a native refresh rate mode 102 in which the display operates at the native refresh rate (e.g., the highest refresh rate possible at full resolution, which is the maximum frequency at which the horizontal gate lines can be turned on one-by-one). In the native refresh rate mode (sometimes referred to as the normal refresh rate mode), the display may have a refresh rate $f_0$. The native refresh rate may be 30 Hz, 60 Hz, 90 Hz, 120 Hz, greater than 60 Hz, between 30 Hz and 150 Hz, between 90 Hz and 150 Hz, between 30 Hz and 90 Hz, less than 300 Hz, or any other desired refresh rate. In the native refresh rate mode, the display may be operable with full resolution. The native refresh rate mode may therefore alternatively be referred to as the full resolution mode or the native refresh rate and full resolution mode.

Each pixel in the display may be capable of having a different brightness value in the full resolution mode. Consider an example where a display has m columns and n rows. The total number of pixels (P) in the display is equal to m×n. In the full resolution mode, all of the pixels have an independently controllable brightness value.

In some applications, a display's native refresh rate may be lower than desired for certain applications. In particular, when content is displayed that includes high levels of motion, increasing the refresh rate may have significant improvements for a viewer's visual experience. The refresh rate may be an even greater determining factor of visual experience than resolution when motion-heavy content is being displayed.

Therefore, the display may also be operable in high refresh rate mode 104. In the high refresh rate mode, the display may be operable at a refresh rate that is an integer multiple (sometimes referred to as a scaling factor) of the native refresh rate (e.g., $2f_0$, $3f_0$, $4f_0$, etc.). Consider an example where the native refresh rate of the display is 120 Hz. In the high refresh rate mode, the display may be operable at an increased frequency of 240 Hz (e.g., $2f_0$). In another example, the native refresh rate of the display is 60 Hz. The display may be operable at an increased frequency of 120 Hz (e.g., $2f_0$), 180 Hz (e.g., $3f_0$), or 240 Hz (e.g., $4f_0$).

In the increased refresh rate mode, the resolution of the display may be decreased. Specifically, the resolution of the display may be decreased by the same integer multiple that the refresh rate increases. In other words, if the refresh rate is twice as high as the native refresh rate in the high refresh rate mode, the resolution will be half as much as in the native refresh rate mode. If the refresh rate is three times as high as the native refresh rate in the high refresh rate mode, the resolution will be one third as much as in the native refresh rate mode. If the refresh rate is four times as high as the native refresh rate in the high refresh rate mode, the resolution will be one quarter as much as in the native refresh rate mode.

Due to the reduced resolution in the high refresh rate mode, the high refresh rate mode may sometimes be referred to as partial resolution mode 104 or high refresh rate and partial resolution mode 104.

The resolution may be reduced in the high refresh rate mode by grouping pixel rows together. Each row in a group is then scanned in parallel with the same pixel data. Therefore, a first row in the pixel group will have the same data as the second row in the pixel group. Resolution is sacrificed in the vertical direction in the high refresh rate mode. If the high refresh rate is $2f_0$, then the total number of effective rows (in an m×n array) in the high refresh rate mode is n/2, while the total number of effective columns remains m. If the high refresh rate is $3f_0$, then the total number of effective rows in the high refresh rate mode is n/3, while the total number of effective columns remains m. Therefore, as the refresh rate is increased by a given scaling factor in the high refresh rate mode, the number of effective pixels is reduced by the same scaling factor.

Therefore, in the high refresh rate mode, pixel resolution (e.g., the total number of effective pixels in the display) may be sacrificed to increase the refresh rate past the native refresh rate. It should be noted that the pixel resolution is only decreased in the vertical direction (e.g., the number of effective rows is reduced while the number of effective columns remains the same). The human eye may be more sensitive to resolution in the horizontal direction than in the vertical direction. Therefore, sacrificing resolution in the vertical direction may have a lesser overall impact on the viewing experience than sacrificing resolution in the horizontal direction. Increasing the refresh rate may significantly improve the viewing experience when viewing content with high motion levels. Therefore, when moving content (e.g., sports content, gaming content, etc.) is displayed on the display, the display may operate in high refresh rate mode 104. However, if static content (e.g., text) is being displayed on the display, the higher resolution of the native refresh rate mode 102 may result in a better viewing experience.

The operating mode of the display may be selected by a user. For example, the user may have the option of toggling between operating modes in a settings page. This allows the user to select the operating mode suitable for their personal preference and primary usage. In another possible embodiment, control circuitry within the display may analyze the type of content being displayed and select a setting based on the type of content identified. For example, if a web-browser or text-based application is identified as being used, the type of content may be primarily static and the control circuitry may place the display in the native refresh rate mode. If a game with high levels of motion is identified as being used, the control circuitry may place the display in the high refresh rate mode. A graphics processing unit (GPU) (e.g., within control circuitry 16 of FIG. 1) or other desired component may analyze the content being displayed and determine whether to operate with the normal refresh rate mode or high refresh rate mode based on the analyzed content.

In the example of FIG. 3, the display operates in either a native refresh rate mode or a high refresh rate mode. This example is merely illustrative. If desired, the display may be operable in multiple different high refresh rate modes. For example, in a first high refresh rate mode, the display may be operable at $2f_0$, in a second high refresh rate mode, the display may be operable at $3f_0$, in a third high refresh rate mode, the display may be operable at $4f_0$, etc. In other words, the display may be operable in one or more high refresh rate modes that each has an associated refresh rate that is higher than the native refresh rate by a unique scaling factor. The display may also be operable in one or more low refresh rate modes. In the low refresh rate modes, the refresh rate may be lower than the native refresh rate while maintaining full display resolution (e.g., to conserve power).

Figure 4:
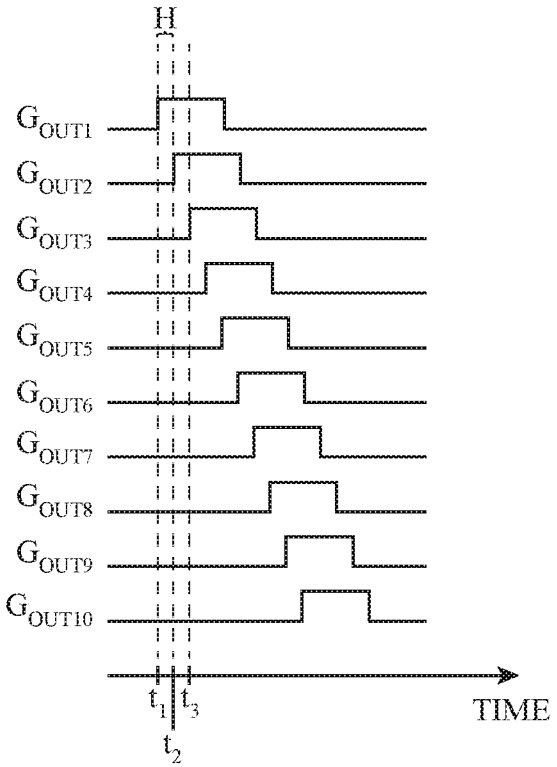
FIG. 4 is a timing diagram showing illustrative gate line outputs for a display while operating in a native refresh rate mode in accordance with an embodiment.

FIG. 4 is a timing diagram showing illustrative gate line outputs for a display that is operating in the native refresh rate mode. Each depicted gate line output ($G_{OUT1}$, $G_{OUT2}$, $G_{OUT3}$, etc.) has a corresponding row of pixels (e.g., row 1, row 2, row 3, etc.). The gate line output is provided to each pixel in its corresponding row of pixels. As discussed above in connection with FIG. 2, each gate line output may be used to control one or more transistors in each display pixel in the row.

As shown in FIG. 4, each gate output is pulsed at a different time. At $t_1$, the signal on $G_{OUT1}$ is pulsed high. At $t_2$, subsequent to $t_1$, the signal on $G_{OUT2}$ is pulsed high. At $t_3$, subsequent to $t_2$, the signal on $G_{OUT3}$ is pulsed high. This pattern may continue for all of the rows of pixels in the display. In other words, at the native refresh rate, the gate line pulse for each row is independent (e.g., the gate lines are scanned sequentially with each gate line receiving a unique control signal). The time between the $G_{OUT1}$ pulse and the $G_{OUT2}$ pulse (e.g., $t_2-t_1$) may be the shortest achievable time between the two pulses. This time is sometimes referred to as the H time. The H time may be the determining factor for the native refresh rate in the display.

Figure 5:
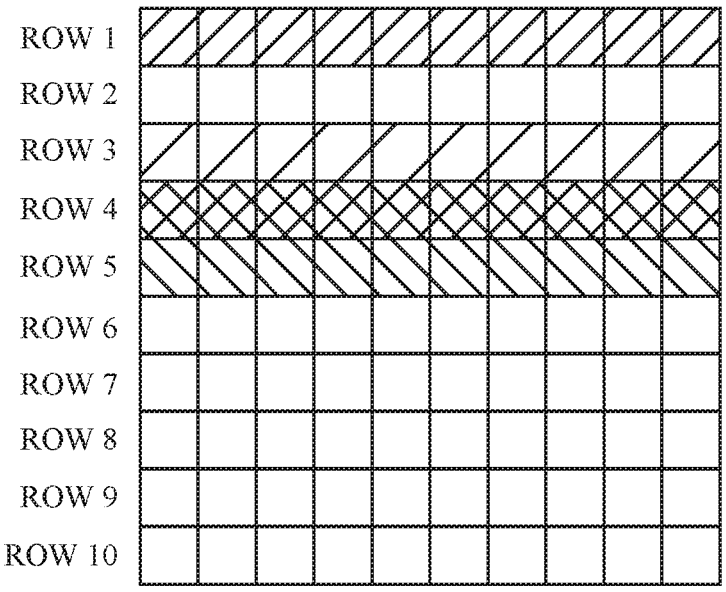
FIG. 5 is a top view of an illustrative display in the native refresh rate mode showing how each row of display pixels is scanned individually in accordance with an embodiment.

FIG. 5 is a schematic diagram of a display operating at the native refresh rate. FIG. 5 shows rows of display pixels, with cross-hatching illustrating how each row of display pixels is operated independently from one another. In other words, data may be loaded and displayed on row 1 at a first time, data may be loaded and displayed on row 2 at a second time that is subsequent to the first time, data may be loaded and displayed on row 3 at a third time that is subsequent to the second time, etc. Therefore, the display has full resolution when operating in the normal refresh rate mode.

Figure 6:
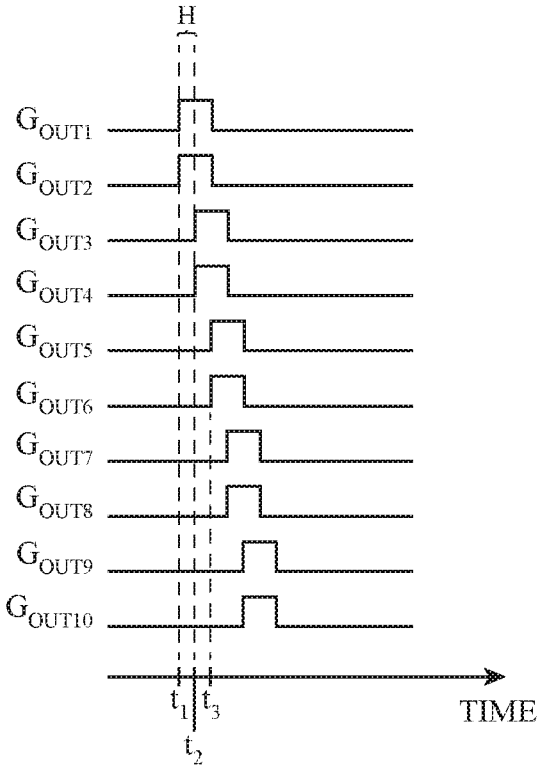
FIG. 6 is a timing diagram showing illustrative gate line outputs for a display while operating in a high refresh rate mode with a refresh rate that is twice the native refresh rate in accordance with an embodiment.

FIG. 6 is a timing diagram showing illustrative gate line outputs for a display that is operating in the high refresh rate mode. In the example of FIG. 6, the display is operating at a refresh rate of $2f_0$ (e.g., double the native refresh rate). As shown in FIG. 6, to operate in this high refresh rate mode both gate line outputs $G_{OUT1}$ and $G_{OUT2}$ are pulsed high at $t_1$. In other words, the output signal on $G_{OUT1}$ and $G_{OUT2}$ is effectively the same (e.g., has the same waveform). Next, at $t_2$, gate line outputs $G_{OUT3}$ and $G_{OUT4}$ are both pulsed high. The output signal on $G_{OUT3}$ and $G_{OUT4}$ is effectively the same (e.g., has the same waveform). Next, at $t_3$, gate line outputs $G_{OUT5}$ and $G_{OUT6}$ are both pulsed high. The output signal on $G_{OUT5}$ and $G_{OUT6}$ is effectively the same (e.g., has the same waveform). This pattern continues for the remaining rows in the display, with each pair of adjacent rows having identical corresponding gate line outputs (e.g., the gate line pulses are concurrent).

In FIG. 6, the H time between pulses (e.g., $t_2-t_1$) occurs between the pulses of the first two rows and the pulses of the second two rows. The $G_{OUT3}$ pulse is separated from the $G_{OUT1}$ pulse by only 1 H time. This in in comparison to FIG. 4 (e.g., the native refresh rate mode), where the $G_{OUT3}$ pulse is separated from the $G_{OUT1}$ pulse by 2 H times.

Figure 7:
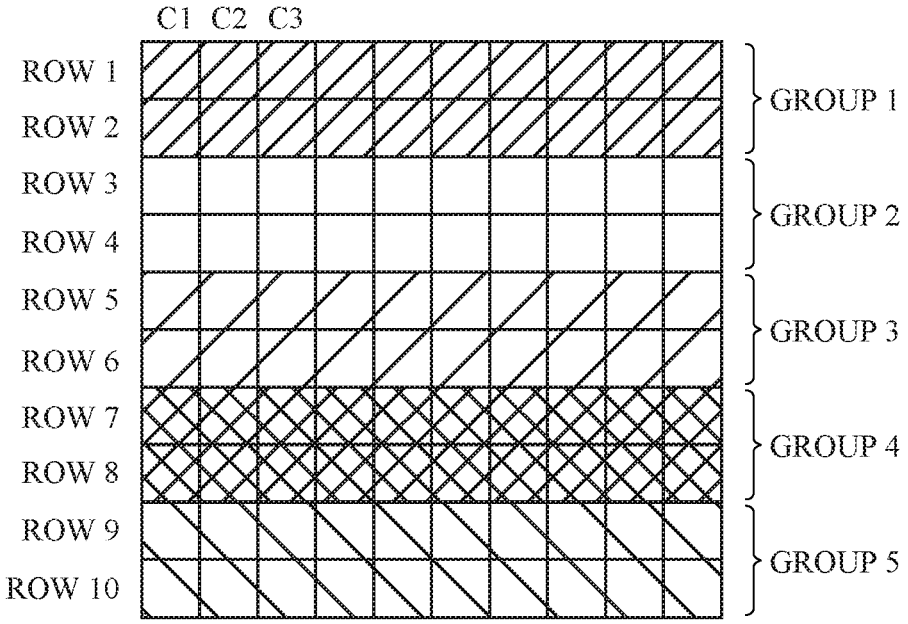
FIG. 7 is a top view of an illustrative display in a high refresh rate mode with a refresh rate that is twice the native refresh rate showing how each pair of adjacent two rows of display pixels are grouped during scanning in accordance with an embodiment.

Due to the driving scheme of FIG. 6 with pairs of adjacent rows being driven with the same outputs, the pairs of adjacent rows are operated together, as shown in FIG. 7. FIG. 7 shows rows of display pixels, with cross-hatching illustrating how each pair of rows is grouped together. As shown, rows 1 and 2 may be grouped together into group 1. Rows 3 and 4 may be grouped together into group 2. Rows 5 and 6 may be grouped together into group 3. Rows 7 and 8 may be grouped together into group 4. Rows 9 and 10 may be grouped together into group 5.

The display pixel groups may sometimes be referred to as effective pixel rows. In FIG. 5, each effective pixel row includes only one actual pixel row. In FIG. 7, each effective pixel row includes two actual pixel rows. Data may be loaded and displayed on group 1 (rows 1 and 2) at a first time, data may be loaded and displayed on group 2 (rows 3 and 4) at a second time that is subsequent to the first time, data may be loaded and displayed on group 3 (rows 5 and 6) at a third time that is subsequent to the second time, etc.

Because the adjacent rows are grouped together, each pixel within a given column in a particular group is used to display the same image data. For example, the display pixels in rows 1 and 2 of column 1 (C1) both have the same brightness levels, the display pixels in rows 1 and 2 of column 2 (C2) both have the same brightness levels, the display pixels in rows 1 and 2 of column 3 (C3) both have the same brightness levels, etc.

To summarize, in the high refresh rate mode each group of rows includes an actual number of rows that is equal to the scaling factor of the high refresh rate compared to the native refresh rate (e.g., if the high refresh rate is $2f_0$, each group includes 2 rows of pixels, if the high refresh rate is $3f_0$, each group includes 3 rows of pixels, etc.).

Figure 8:
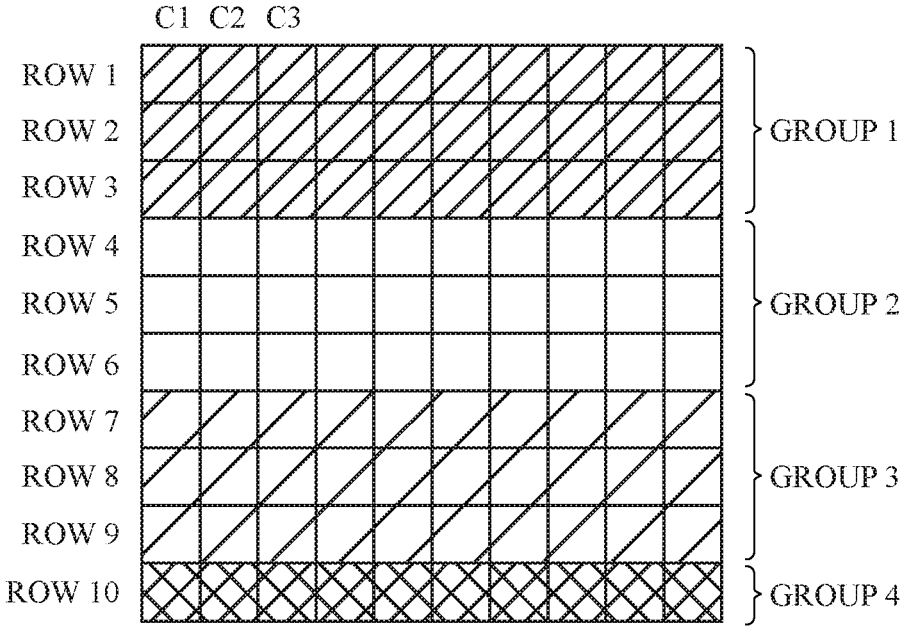
FIG. 8 is a top view of an illustrative display in a high refresh rate mode with a refresh rate that is three times the native refresh rate showing how each set of three adjacent rows of display pixels are grouped during scanning in accordance with an embodiment.

FIG. 8 shows rows of display pixels, with cross-hatching illustrating how each pair of rows is grouped together in a $3f_0$ high refresh rate mode. As shown, rows 1, 2, and 3 may be grouped together into group 1. Rows 4, 5, and 6 may be grouped together into group 2. Rows 7, 8, and 9 may be grouped together into group 3. Rows 10, 11, and 12 may be grouped together into group 4 (note that only row 10 is explicitly shown in FIG. 8).

The display pixel groups may sometimes be referred to as effective pixel rows. In FIG. 5, each effective pixel row includes only one actual pixel row. In FIG. 8, each effective pixel row includes three actual pixel rows. Data may be loaded and displayed on group 1 (rows 1, 2, and 3) at a first time, data may be loaded and displayed on group 2 (rows 4, 5, and 6) at a second time that is subsequent to the first time, data may be loaded and displayed on group 3 (rows 7, 8, and 9) at a third time that is subsequent to the second time, etc.

Because each set of three adjacent rows are grouped together, each pixel within a given column in a particular group is used to display the same image data. For example, the display pixels in rows 1, 2, and 3 of column 1 (C1) all have the same brightness levels, the display pixels in rows 1, 2, and 3 of column 2 (C2) all have the same brightness levels, the display pixels in rows 1, 2, and 3 of column 3 (C3) all have the same brightness levels, etc.

Figure 9:
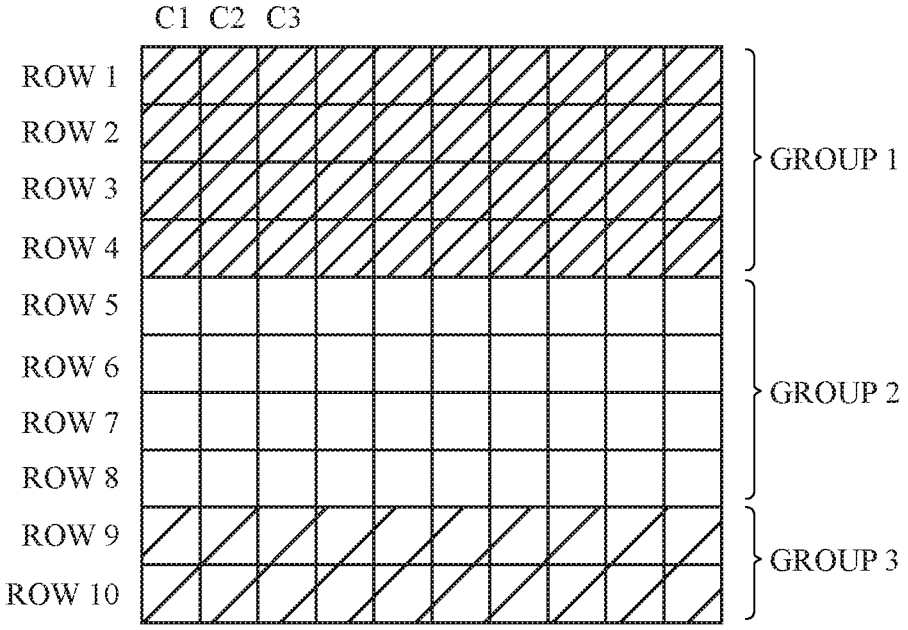
FIG. 9 is a top view of an illustrative display in a high refresh rate mode with a refresh rate that is four times the native refresh rate showing how each set of four adjacent rows of display pixels are grouped during scanning in accordance with an embodiment.

FIG. 9 shows rows of display pixels, with cross-hatching illustrating how each pair of rows is grouped together in a $4f_0$ high refresh rate mode. As shown, rows 1, 2, 3, and 4 may be grouped together into group 1. Rows 5, 6, 7, and 8 may be grouped together into group 2. Rows 9, 10, 11, and 12 may be grouped together into group 3 (note that only rows 9 and 10 are explicitly shown in FIG. 9).

The display pixel groups may sometimes be referred to as effective pixel rows. In FIG. 5, each effective pixel row includes only one actual pixel row. In FIG. 9, each effective pixel row includes four actual pixel rows. Data may be loaded and displayed on group 1 (rows 1, 2, 3, and 4) at a first time, data may be loaded and displayed on group 2 (rows 5, 6, 7, and 8) at a second time that is subsequent to the first time, data may be loaded and displayed on group 3 (rows 9, 10, 11, and 12) at a third time that is subsequent to the second time, etc.

Because each set of four adjacent rows are grouped together, each pixel within a given column in a particular group is used to display the same image data. For example, the display pixels in rows 1, 2, 3, and 4 of column 1 (C1) all have the same brightness levels, the display pixels in rows 1, 2, 3, and 4 of column 2 (C2) all have the same brightness levels, the display pixels in rows 1, 2, 3, and 4 of column 3 (C3) all have the same brightness levels, etc.

Gate driver circuitry 20B may include a shift register formed from a chain of register circuits. Each register circuit may supply horizontal control signals (e.g., switching transistor control signals, emission enable signals, etc.) to a corresponding row of pixels. The shift register may sometimes be referred to as a driver (e.g., an emission driver for providing emission control signals to the pixels, a scan driver for providing control signals to switching transistors of the pixels, etc.). During operation, control circuitry 16 may initiate propagation of a control pulse through the shift register. As the control pulse propagates through the shift register, each gate line G may be activated in sequence, allowing successive rows of pixels 22 to be loaded with data from data lines D. Each register circuit (which may be a flip-flop circuit) may be referred to as a stage of the shift register.

Figure 10:
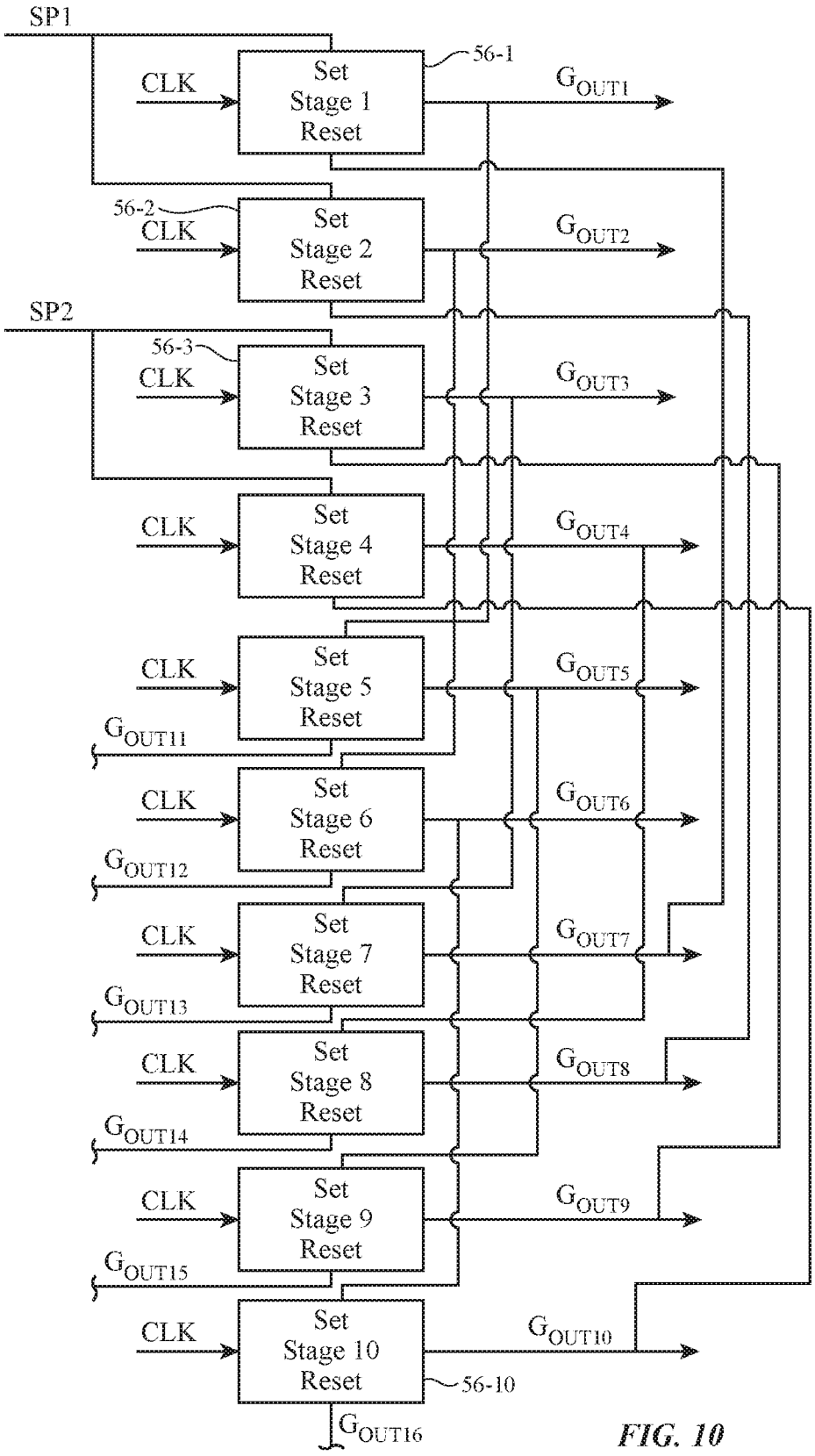
FIG. 10 is a schematic diagram of an illustrative shift register that is operable in a native refresh rate mode and a high refresh rate mode with a refresh rate that is twice the native refresh rate in accordance with an embodiment.

FIG. 10 is a schematic diagram of a shift register that may be included in the gate driver circuitry for the display. The shift register may include a chain of register circuits 56. Each register circuit may supply a horizontal control signal to a corresponding row of pixels. For example, a first register circuit 56-1 may have an output $G_{OUT1}$ that is coupled to the first row of pixels in the display, the second register circuit 56-2 may have an output $G_{OUT2}$ that is coupled to the second row of pixels in the display, the third register circuit 56-3 may have an output $G_{OUT3}$ that is coupled to the third row of pixels in the display, etc. This pattern may continue until the last row of the display.

Each register circuit has a set input (sometimes referred to as a set input terminal) and a reset input (sometimes referred to as a reset input terminal) as shown in FIG. 10. First, consider the set input of each register circuit. The first four register circuits receive start pulses at the set input. Specifically, stages 1 and 2 receive start pulse SP1 whereas stages 3 and 4 receive start pulse SP2. This type of start pulse scheme may enable multiple refresh rate modes, as will be discussed later in greater detail. The subsequent register circuits in the shift register (e.g., stages 5-*n* where n is the total number of rows in the display) receive the output from four stages previous as the set input. For example, the stage 1 output $G_{OUT1}$ is provided to the set input of stage 5, the stage 2 output $G_{OUT2}$ is provided to the set input of stage 6, the stage 3 output $G_{OUT3}$ is provided to the set input of stage 7, the stage 4 output $G_{OUT4}$ is provided to the set input of stage 8, the stage 5 output $G_{OUT5}$ is provided to the set input of stage 9, and the stage 6 output $G_{OUT6}$ is provided to the set input of stage 10. This pattern may continue for the remainder of the shift register (with each register circuit 'x' receiving the output from register circuit x−4 at the set input terminal).

Next, consider the reset input of each register circuit. Each register circuit may receive the output from six stages ahead as the reset input. For example, the stage 7 output $G_{OUT7}$ is provided to the reset input of stage 1, the stage 8 output $G_{OUT8}$ is provided to the reset input of stage 2, the stage 9 output $G_{OUT9}$ is provided to the reset input of stage 3, and the stage 10 output $G_{OUT10}$ is provided to the reset input of stage 4. This pattern may continue for the remainder of the shift register (with each register circuit 'x' receiving the output from register circuit x+6 at the reset input terminal). Dummy register circuits may be provided at the end of the shift register to provide the reset signals to the last register circuits in the shift register (e.g., dummy register circuits n+1 through n+6 may be included to provide reset input to register circuits n−5 through n).

In addition to the set and reset inputs, each register circuit may receive one or more clock signals CLK. During operation, each register circuit is set (by the input to the set input terminal), then triggered (by the clock signals), and then reset (by the input to the reset input terminal).

Figure 11A:
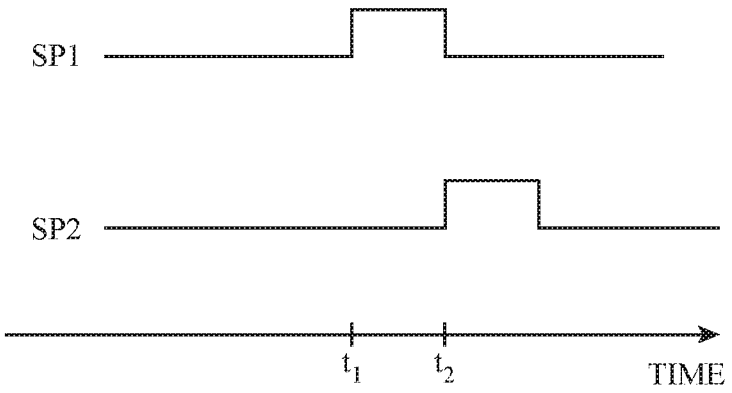
FIG. 11A is a timing diagram showing illustrative start pulses for the shift register of FIG. 10 when the display is in the native refresh rate mode in accordance with an embodiment.

The shift register of FIG. 10 may be capable of operating in two refresh rate modes: a native refresh rate mode at refresh rate $f_0$ and a high refresh rate mode at refresh rate $2f_0$. In the native refresh rate mode, the outputs from the shift register may follow the timing diagram shown in FIG. 4. Specifically, the output for each row is independent and delayed from the previous row by 1 H time. As shown in timing diagram of FIG. 11A, in the native refresh rate mode the SP2 pulse occurs after the SP1 pulse. The SP1 pulse is provided to stages 1 and 2 of the shift register to 'set' the respective register circuits. Then, the register circuits are triggered by corresponding clock signals. Stage 1 may be triggered first, then stage 2 may subsequently be triggered. In other words, the clock signals received may have the same pattern as the shift register outputs in FIG. 4 (since the gate output is high when the clock signal is triggered).

Figure 12A:
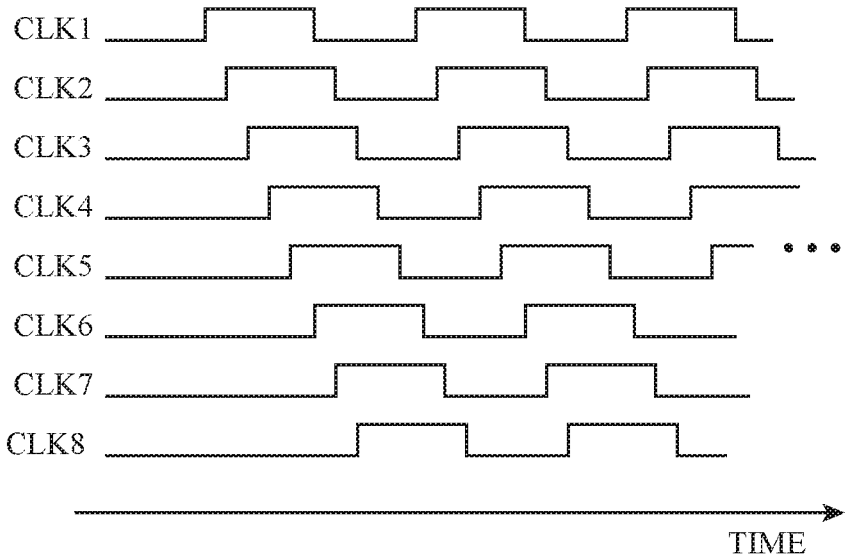
FIG. 12A is a timing diagram showing illustrative clock signals for the shift register of FIG. 10 when the display is in the native refresh rate mode in accordance with an embodiment.

In the example of FIG. 10, there may be eight respective clock signals (sometimes referred to as clock phases). FIG. 12A shows an example timing diagram for the eight clock signals that may be utilized in the shift register of FIG. 10. As shown, the clock signals may be triggered in series to produce an output of the type shown in FIG. 4. The first clock signal may be provided to the first stage of the shift register, the second clock signal may be provided to the second stage of the shift register, etc. This pattern may continue, returning to the first clock signal after the eight clock signal is provided to a shift register. In other words, the first clock signal may be provided to the ninth stage of the shift register, the seventeenth stage of the shift register, etc.

The second clock signal may be provided to the tenth stage of the shift register, the eighteenth stage of the shift register, etc.

As shown in FIG. 12A, after the eighth clock signal (CLK8) is pulsed, the first clock signal (CLK1) is again pulsed. This pattern continues until all of the stages of the shift register have been triggered and provided corresponding outputs of the type shown in FIG. 4.

Figure 11B:
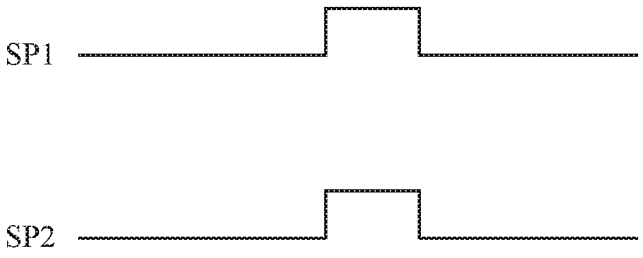
FIG. 11B is a timing diagram showing illustrative start pulses for the shift register of FIG. 10 when the display is in the high refresh rate mode in accordance with an embodiment.

Returning to FIG. 11A, the SP2 pulse is delayed relative to the SP1 pulse in the native refresh rate mode. This is because the delay between the stage 1 output and the stage 3 output is 2 H times in the native refresh rate mode. Alternatively, in the high refresh rate mode (at refresh rate $2f_0$) the delay between the stage 1 output and the stage 3 output is only 1 H time. Accordingly, as shown in the timing diagram of FIG. 11B, in the high refresh rate mode the SP2 start pulse is concurrent with the SP1 start pulse. Therefore, stages 1-4 are all set at the same time. Then, as shown in the clock signal timing diagram of FIG. 12B, clock signals 1 and 2 are pulsed at the same time. After 1 H time elapses, clock signals 3 and 4 are pulsed at the same time. This pattern continues, resulting the high refresh rate mode output pattern shown in FIG. 6.

Figure 12B:
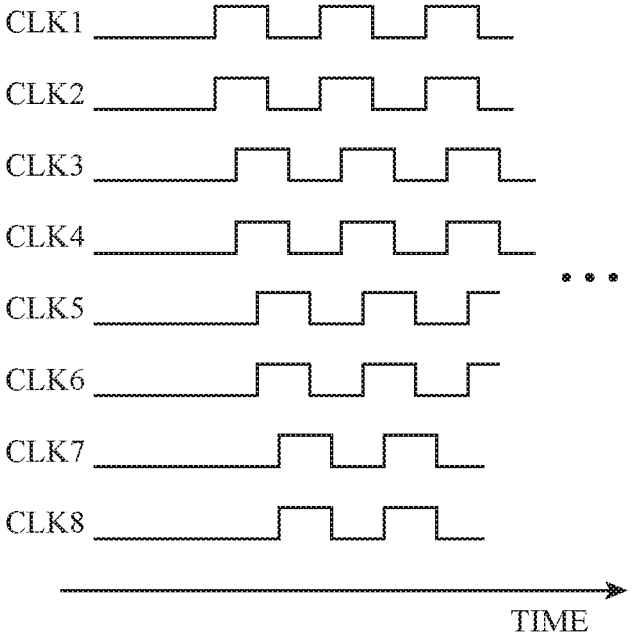
FIG. 12B is a timing diagram showing illustrative clock signals for the shift register of FIG. 10 when the display is in the high refresh rate mode in accordance with an embodiment.

As shown in FIG. 12B, after the seventh and eighth clock signals (CLK7/CLK8) are pulsed, the first and second clock signals (CLK1/CLK2) are again pulsed. This pattern continues until all of the stages of the shift register have been triggered and provided corresponding outputs of the type shown in FIG. 6.

To summarize, the shift register of FIG. 10 is operable in a native refresh rate mode and a high refresh rate mode. The first two stages are set by a first start pulse and the next two stages are set by a second start pulse. All subsequent stages are set by the output from four stages prior in the shift register. All of the stages are reset by the output from six stages subsequent in the shift register. Each stage receives one or more clock signals. In the native refresh rate mode, the first and second start pulses are offset (e.g., not concurrent). The clock signals are then pulsed to trigger each shift register in sequence (as shown in FIG. 12A). In the high refresh rate mode, the first and second start pulses are concurrent. The clock signals are then pulsed to trigger each pair of shift registers in sequence (as shown in FIG. 12B). The duration of the clock pulse (and corresponding output pulse) in the high refresh rate mode is half of the length of time of the duration of the clock pulse in the native refresh rate mode.

Display driver circuitry 20 may include a timing controller (TCON) that provides the appropriate clock signals and start pulses to the shift register of FIG. 10 (based on whether the display is in the native refresh rate mode or the high refresh rate mode). The timing controller may receive a notification of which mode to operate in from another system component (e.g., control circuitry 16 in FIG. 1).

As previously mentioned, the gate driver circuitry 20B in the display may be formed using one or more integrated circuits and/or may be implemented using thin-film transistor circuitry on substrate 26. In the example of FIG. 10, the gate driver circuitry may be formed using thin-film transistor circuitry on substrate 26.

Figure 13:
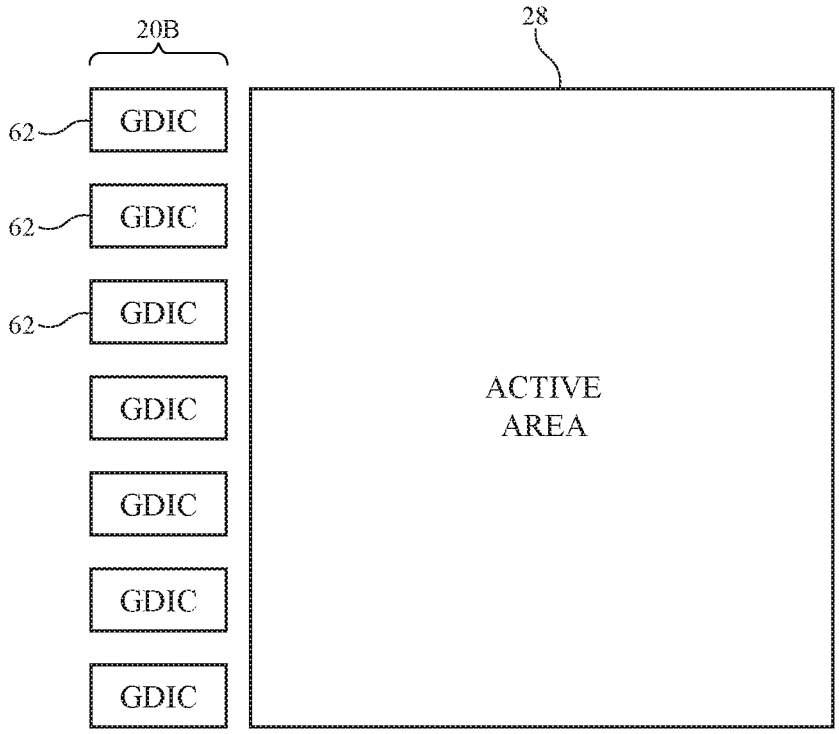
FIG. 13 is a top view of an illustrative display with gate driver circuitry formed from integrated circuits in accordance with an embodiment.

FIG. 13 is a top view of an illustrative display with gate driver circuitry formed using integrated circuits. As shown, gate driver circuitry 20B may include a number of gate driver integrated circuits (GDICs) adjacent to active area 28. Each gate driver integrated circuit 62 may control a plurality of gate line outputs that are each used to control one or more transistors in each display pixel in the row. The display may include any desired number of gate driver integrated circuits (e.g., more than one, more than two, more than three, more than five, more than seven, more than nine, more than ten, more than fifteen, more than twenty, more than fifty, less than three, less than five, less than seven, less than nine, less than ten, less than fifteen, less than twenty, less than fifty, between five and fifteen, between five and twelve, etc.). Each gate driver integrated circuit may provide any desired number of gate outputs (e.g., more than fifty, more than one hundred, more than three hundred, more than five hundred, more than one thousand, less than three thousand, less than one thousand, between three hundred and one thousand, between fifty and five hundred, etc.).

Figure 14:
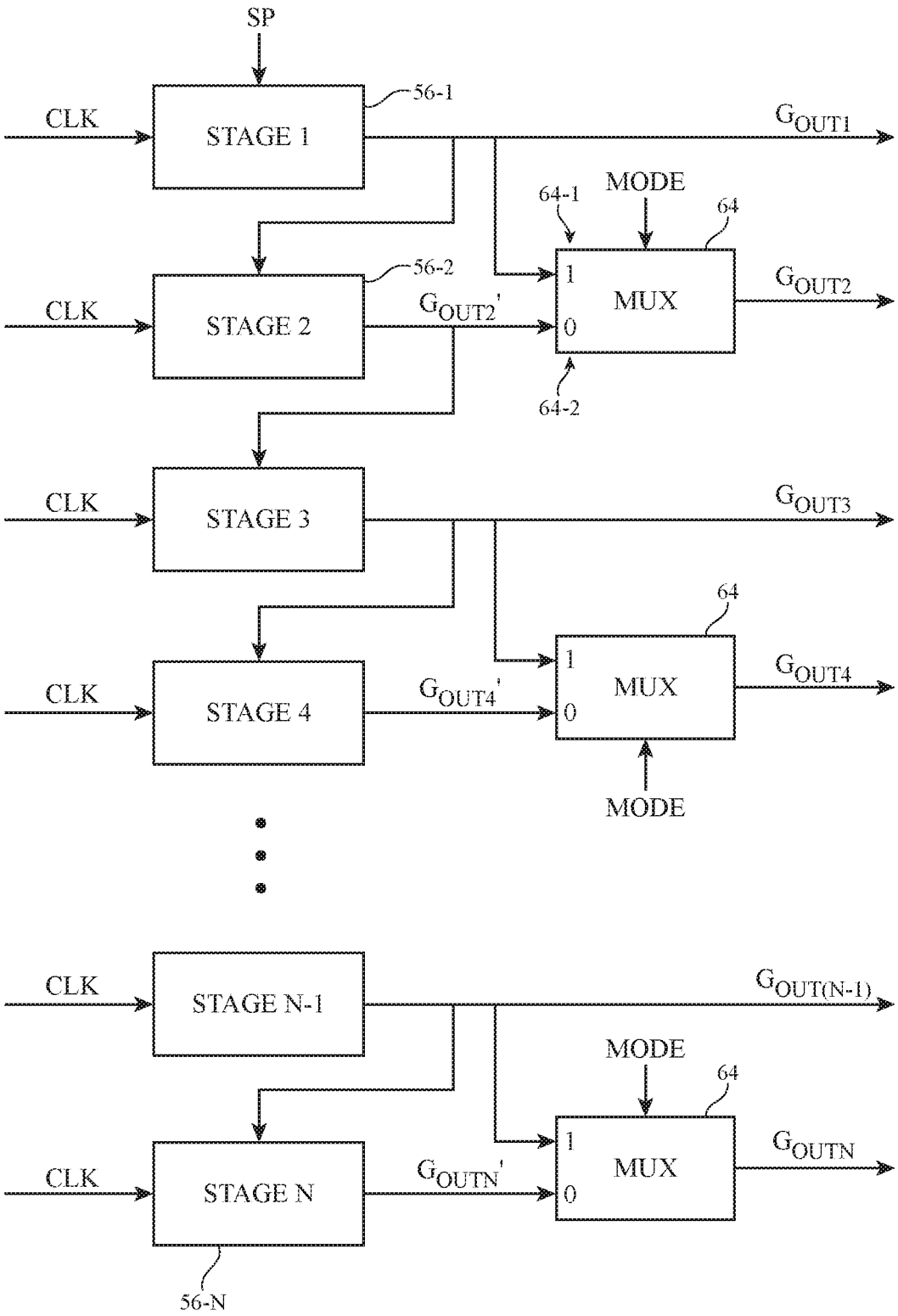
FIG. 14 is a schematic diagram of an illustrative shift register that is implemented using the integrated circuits of FIG. 13 and that is operable in a native refresh rate mode and a high refresh rate mode with a refresh rate that is twice the native refresh rate in accordance with an embodiment.

Each gate driver integrated circuit may include one or more shift registers for providing gate line outputs. FIG. 14 is a schematic diagram of an illustrative shift register that may be included in a gate driver integrated circuit and that may be operable in a native refresh rate mode and a high refresh rate mode.

Each register circuit in the shift register of FIG. 14 may supply horizontal control signals (e.g., switching transistor control signals, emission enable signals, etc.) to a corresponding row of pixels. The shift register may sometimes be referred to as a driver (e.g., an emission driver for providing emission control signals to the pixels, a scan driver for providing control signals to switching transistors of the pixels, etc.). During operation, control circuitry (e.g., a timing controller and/or control circuitry 16) may initiate propagation of a control pulse through the shift register. As the control pulse propagates through the shift register, each gate line G may be activated in sequence, allowing successive rows of pixels 22 to be loaded with data from data lines D. Each register circuit (which may be a flip-flop circuit) may be referred to as a stage of the shift register.

As shown in FIG. 14, the shift register may include a chain of register circuits 56. Each register circuit may supply a horizontal control signal to a corresponding row of pixels. For example, a first register circuit 56-1 may have an output $G_{OUT1}$ that is coupled to the first row of pixels in the display, the second register circuit 56-2 may have an output $G_{OUT2}$ that is coupled to the second row of pixels in the display, the $N^{th}$ register circuit (e.g., the register circuit associated with the last row in the display) 56-N may have an output $G_{OUTN}$ that is coupled to the last row of pixels in the display, etc. This pattern may continue across the entire display.

The first stage of the shift register may receive a start pulse SP and may provide a corresponding output $G_{OUT1}$. The output of the first stage is then provided as an input to the second stage of the shift register. Stage two provides a corresponding output $G_{OUT2}'$, which is also used as input to stage three. This pattern may be propagated through the entire display, with the output of each register circuit being provided as input to the subsequent register circuit (e.g., to the set terminal of the subsequent register circuit). Each register circuit may also receive a clock signal CLK. One or more clock signals may be used to operate the shift register. Each register circuit may also receive a reset signal (e.g., from a subsequent stage), similar to as discussed in connection with the shift register of FIG. 10.

The shift register of FIG. 14 also includes a plurality of multiplexers 64. Specifically, each even numbered row (e.g., row 2, row 4, row 6, etc.) may have an associated multiplexer. The multiplexer may enable the shift register to operate in either the native refresh rate mode or the high refresh rate mode. As shown in FIG. 14, each multiplexer may have a first input 64-1, a second input 64-2, and may receive a mode select signal (MODE). The first input 64-1 may be coupled directly to the output of the previous stage. For example, the multiplexer of row 2 receives the output $G_{OUT1}$ at input terminal 64-1. The second input 64-2 may receive the output from the same stage as the multiplexer. For example, the multiplexer of row 2 receives output $G_{OUT2}'$ at the input terminal 64-2.

Based on the mode select signal, multiplexer 64 may provide either the signal from input terminal 64-1 or the signal from input terminal 64-2 as output $G_{OUT2}$. If the shift register is operating in a native refresh rate mode, the mode select signal may equal '0' and the input at terminal 64-2 is provided as $G_{OUT2}$ (e.g., $G_{OUT2}'$ is provided as $G_{OUT2}$). If the shift register is operating in a high refresh rate mode, the mode select signal may equal '1' and the input at terminal 64-1 is provided as $G_{OUT2}$ (e.g., $G_{OUT1}$ is provided as $G_{OUT2}$).

Therefore, in the native refresh rate mode, the output from each respective stage is utilized. Consequently, a gate line output pattern of the type shown in FIG. 4 (with the output of each row being pulsed sequentially) occurs in the native refresh rate mode. In the high refresh rate mode, every other stage of the shift register uses the output from the previous stage instead of its own stage. In other words, in the high refresh rate mode, $G_{OUT2}=G_{OUT1}$, $G_{OUT4}=G_{OUT3}$, $G_{OUT6}=G_{OUT5}$, etc. Therefore, each adjacent pair of register circuits has the same output (e.g., outputs following the same concurrent waveform), similar to as shown in FIG. 6.

The examples above of a display with a high refresh rate mode that is twice the refresh rate of the native refresh rate mode are merely illustrative. As previously mentioned, the display may instead or in addition be operable with a high refresh rate mode that is three (or some other scaling factor) times the refresh rate of the native refresh rate mode. To support a $3f_0$ refresh rate mode, each register circuit x of FIG. 10 may provide its output to a sixth subsequent register circuit (x+6). In FIG. 14, a multiplexer may be included for two of every three rows to support a $3f_0$ refresh rate mode. The multiplexer for row 2 will either output the stage 1 output (in the high refresh rate mode) or stage 2 output (in the native refresh rate mode). Similarly, the multiplexer for row 3 will either output the stage 1 output (in the high refresh rate mode) or stage 3 output (in the native refresh rate mode). Additional multiplexers and/or multiplexer inputs may be used to enable the gate driver circuitry with multiple high refresh rate modes (e.g., a $2f_0$ refresh rate mode and a $3f_0$ refresh rate mode).

If the display having a native refresh rate mode and at least one high refresh rate mode is a liquid crystal display, the inversion configuration of the display may be selected to match the gate driving configuration. For example, in a high refresh rate mode with a refresh rate of $2f_0$, a vertical 2 dot z-inversion scheme may be used. In another example, a column inversion scheme may be used.

The foregoing is merely illustrative and various modifications can be made by those skilled in the art without departing from the scope and spirit of the described embodiments. The foregoing embodiments may be implemented individually or in any combination.

What is claimed is:

1. A display comprising:

a plurality of display pixels arranged in rows and columns;

display driver circuitry configured to provide image data to the columns of display pixels; and gate driver circuitry configured to provide control signals to the rows of display pixels, wherein the gate driver circuitry includes a shift register that is operable in a native refresh rate mode at a first refresh rate and a high refresh rate mode at a second refresh rate that is twice the first refresh rate, wherein in the native refresh rate mode the shift register sequentially provides control signals to each row of all the display pixels, and wherein in the high refresh rate mode the shift register sequentially provides control signals to each pair of adjacent rows of all the display pixels.

2. The display defined in claim 1, wherein the shift register comprises a plurality of register circuits and wherein each register circuit is associated with a respective row of display pixels.

3. The display defined in claim 2, wherein first and second register circuits associated with first and second rows of the display pixels receive a first start pulse and wherein third and fourth register circuits associated with third and fourth rows of the display pixels receive a second start pulse.

4. The display defined in claim 3, wherein each remaining register circuit receives an output from a register circuit four rows before the respective row of that register circuit.

5. The display defined in claim 3, wherein in the native refresh rate mode the first and second start pulses are staggered.

6. The display defined in claim 5, wherein in the high refresh rate mode the first and second start pulses are concurrent.

7. The display defined in claim 6, wherein each register circuit receives at least one clock signal that triggers an output of the register circuit.

8. The display defined in claim 7, wherein in the native refresh rate mode the second register circuit is triggered after the first register circuit and wherein in the high refresh rate mode the second register circuit is triggered concurrently with the first register circuit.

9. The display defined in claim 8, wherein the gate driver circuitry is formed from thin-film transistor circuitry.

10. The display defined in claim 2, wherein each register circuit has a reset input that receives an output from a register circuit six rows after the respective row of that register circuit.

11. The display defined in claim 1, wherein the first refresh rate is 120 Hz and the second refresh rate is 240 Hz.

12. The display defined in claim 1, wherein the first refresh rate is 60 Hz and the second refresh rate is 120 Hz.

13. A display comprising:

a plurality of display pixels arranged in rows and columns;

display driver circuitry configured to provide image data to the columns of display pixels; and gate driver circuitry configured to provide control signals to the rows of display pixels, wherein the gate driver circuitry includes a shift register that is operable in a native refresh rate mode at a first refresh rate and a high refresh rate mode at a second refresh rate that is twice the first refresh rate, wherein in the native refresh rate mode the shift register sequentially provides control signals to each row of display pixels, wherein in the high refresh rate mode the shift register sequentially provides control signals to each pair of adjacent rows of display pixels, wherein the shift register comprises a plurality of register circuits, wherein each register circuit is associated with a respective row of display pixels, and wherein the register circuit in every other row has an associated multiplexer.

14. The display defined in claim 13, wherein each multiplexer receives an output from a register circuit in a same row as the multiplexer as a first input and receives an output from a register circuit in a preceding row as the multiplexer as a second input.

15. The display defined in claim 14, wherein each multiplexer outputs the first input in the native refresh rate mode and outputs the second input in the high refresh rate mode.

16. The display defined in claim 15, wherein each multiplexer receives a mode select control signal that identifies a selected one of the native refresh rate mode and the high refresh rate mode.

17. The display defined in claim 13, wherein the register circuit in every even row has the associated multiplexer.

18. An electronic device comprising:

a display that is operable in a first mode at a first refresh rate and a second mode at a second refresh rate, wherein the display comprises:

an array of rows and columns of pixels;

a plurality of data lines, wherein each data line is associated with a respective column of pixels;

a plurality of gate lines, wherein each gate line is associated with a respective row of pixels;

display driver circuitry configured to provide image data to the data lines; and gate driver circuitry configured to provide control signals to the gate lines, wherein the second refresh rate is greater than the first refresh rate by an integer multiple, wherein the gate driver circuitry scans each row of all the pixels in sequence in the first mode, wherein the gate driver circuitry scans effective rows of all the pixels in sequence in the second mode, and wherein each effective row includes a number of rows that is equal to the integer multiple.

19. The electronic device defined in claim 18, wherein the integer multiple is two, wherein the gate driver circuitry is configured to concurrently scan first and second rows at a first time in the second mode, and wherein the gate driver circuitry is configured to concurrently scan third and fourth rows at a second time subsequent to the first time in the second mode.

* * * * *